US007556535B2

(12) United States Patent
Liao

(10) Patent No.: US 7,556,535 B2
(45) Date of Patent: Jul. 7, 2009

(54) ADAPTER HAVING CONNECTING ARMS

(76) Inventor: Sheng-Hsin Liao, No. 10, Alley 38, Lane 229, San Chun St., Shulin City (TW)

( * ) Notice: Subject to any disclaimer, the term of this patent is extended or adjusted under 35 U.S.C. 154(b) by 0 days.

(21) Appl. No.: 11/979,473

(22) Filed: Nov. 5, 2007

(65) Prior Publication Data

US 2009/0117768 A1 May 7, 2009

(51) Int. Cl.
*H01R 25/00* (2006.01)

(52) U.S. Cl. ..... 439/640

(58) Field of Classification Search ..... 439/640, 439/651, 638, 172

See application file for complete search history.

(56) References Cited

U.S. PATENT DOCUMENTS 2,975,412 A * 3/1961 Fuller et al. ..... 340/815.73
3,025,486 A * 3/1962 Falconer ..... 439/103
4,769,906 A * 9/1988 Purpura et al. ..... 29/857
4,997,381 A * 3/1991 Oh ..... 439/172
5,648,712 A * 7/1997 Hahn ..... 320/111
5,681,171 A * 10/1997 Park ..... 439/31
5,773,332 A * 6/1998 Glad ..... 439/344
6,126,460 A * 10/2000 Wu ..... 439/131
6,142,834 A * 11/2000 Liao ..... 439/676
6,213,782 B1 * 4/2001 Derstine ..... 439/31
6,767,256 B1 * 7/2004 Faerber et al. ..... 439/668
6,957,977 B1 * 10/2005 Miller ..... 439/369
7,179,099 B2 * 2/2007 Hsieh ..... 439/131
7,255,567 B1 * 8/2007 Liao ..... 439/11
7,287,994 B1 * 10/2007 Liao ..... 439/172
2006/0073717 A1 * 4/2006 Ng et al. ..... 439/131
2008/0050975 A1 * 2/2008 Liao ..... 439/660

* cited by examiner

*Primary Examiner*—Vladimir Imas
(74) *Attorney, Agent, or Firm*—Rosenberg, Klein & Lee

(57) ABSTRACT

An adapter has connecting arms and includes a casing, a first plugging element and a second plugging element. The casing has connecting arms and is provided with pivoting portions. The side edges of the casing are formed with first sliding grooves. The first and the second plugging element are electrically connected inside the casing, and face in opposite directions. Via this arrangement, the adapter can be assembled with a plug and can be assembled with other adapters of different specifications and types, thereby providing more functionality.

17 Claims, 9 Drawing Sheets

ADAPTER HAVING CONNECTING ARMS

BACKGROUND OF THE INVENTION

1. Field of the Invention

The present invention is related to an adapter having connecting arms, and more particular to an adapter that can be assembled with a plug and other adapters of different specifications or types, thereby diversifying the purposes thereof to provide more functionality.

2. Description of Related Art

When a conventional power supply line is to be electrically connected to an electronic apparatus, a power supply plug combined with one end of the power supply line is inserted into a corresponding socket on the electronic device. With the power supply plug being electrically connected with the socket, the power supply line can be electrically connected with the electronic device.

If the specification and type of the power supply plug are different from those of the socket, the power supply plug should be assembled with an adapter first. Then, the adapter is inserted into the socket to achieve the electrical connection between the power supply plug and the socket.

However, the conventional adapter can be only assembled with a corresponding power supply plug, so that the adapter cannot be assembled with other adapters of different specifications and types. As a result, the purpose of the conventional adapter is so limited that it cannot have more functionality.

Consequently, because of the above technical defects, the inventor keeps on carving unflaggingly through wholehearted experience and research to develop the present invention, which can effectively improve the defects described above.

SUMMARY OF THE INVENTION

The object of the present invention is to provide an adapter having connecting arms, which can be assembled with a plug and other adapters of different specifications and types, thereby providing more functionality.

For achieving the object described above, the present invention provides an adapter having connecting arms, which includes: a casing having connecting arms and provided with pivoting portions, side edges of the casing being formed with first sliding grooves; and a first plugging element and a second plugging element, the first plugging element and the second plugging element being electrically connected inside the casing, and facing in opposite directions.

The present invention has advantageous effects as follows. Since the casing of the adapter of the present invention is provided with first sliding grooves for allowing another adapter to be assembled therewith, the adapter can not only be assembled with a corresponding plug, but also can be assembled with other adapters of different specifications and types, thereby diversifying the purposes thereof to provide more functionality.

In order to further understand the characteristics and technical contents of the present invention, a detailed description is made with reference to the accompanying drawings. However, it should be understood that the drawings are illustrative only but not used to limit the present invention thereto.

DETAILED DESCRIPTION OF THE PREFERRED EMBODIMENTS

Figure 1:
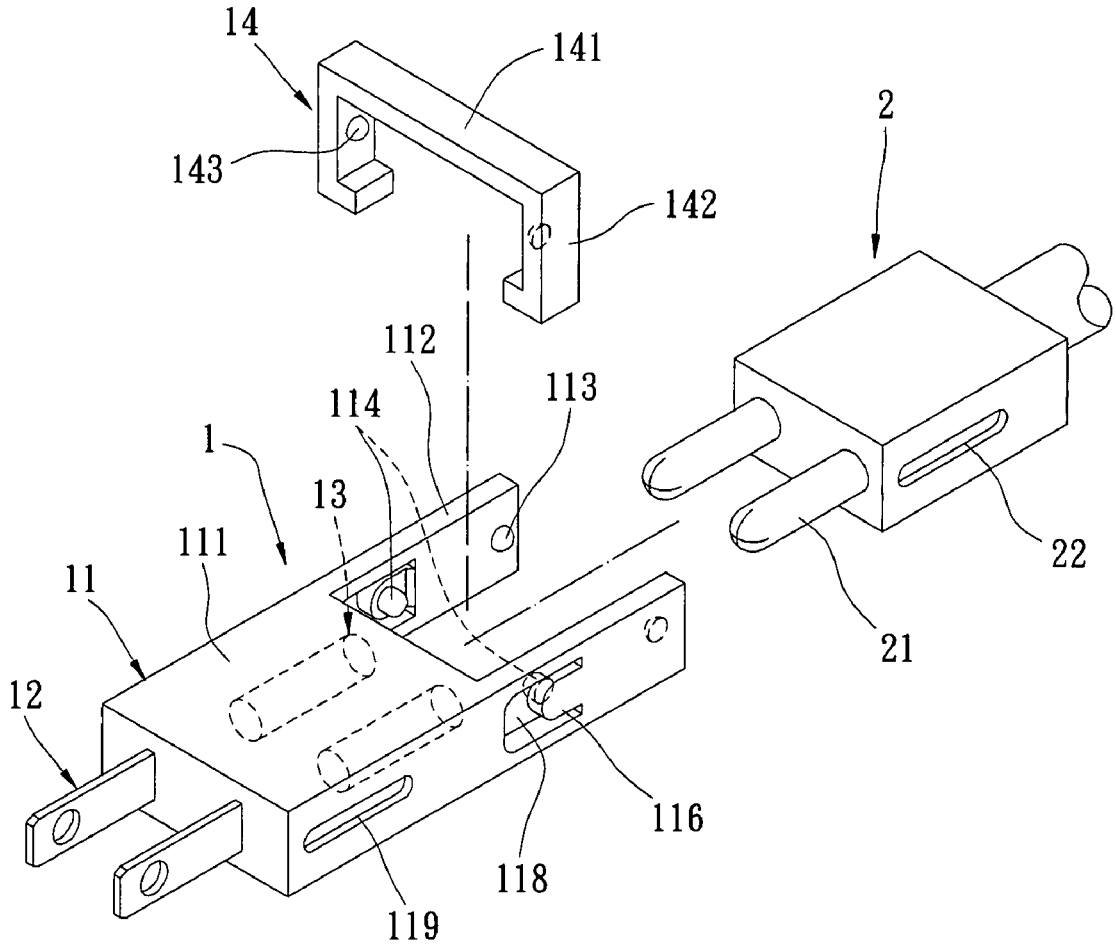
FIG. 1 is an exploded perspective view showing a first embodiment of the present invention.
Figure 2:
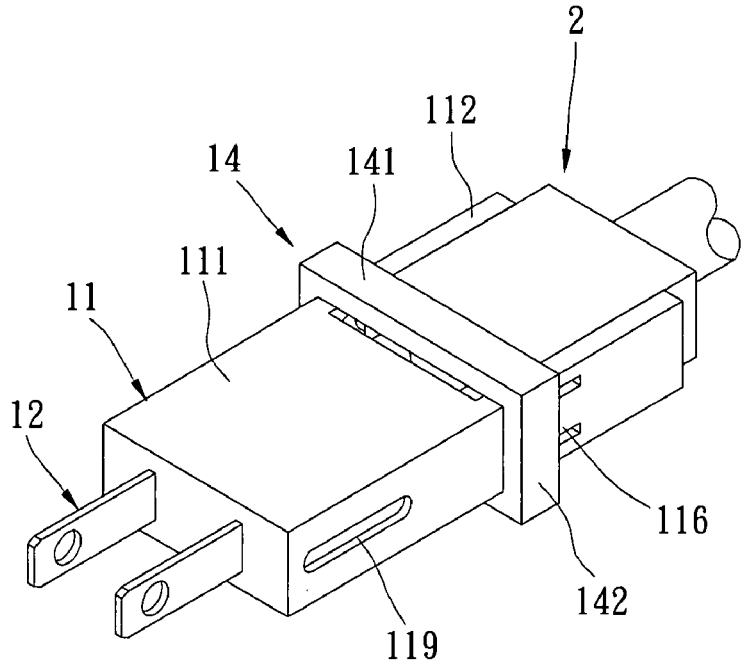
FIG. 2 is an assembled perspective view showing the first embodiment of the present invention.
Figure 3:
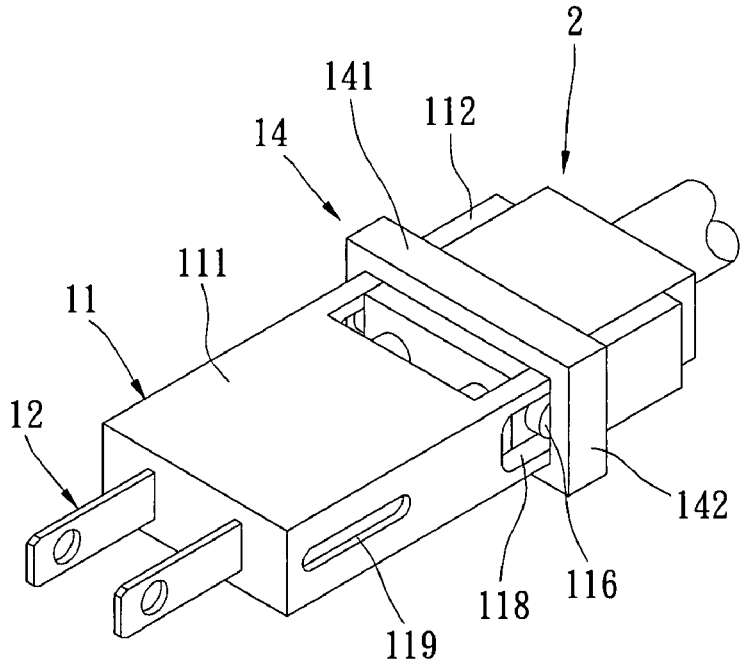
FIG. 3 is a perspective view showing the abutting portion of the first embodiment of the present invention abutting against the surface of the outer edge of the elastic arm.

Please refer to FIGS. 1 to 3. The present invention provides an adapter having connecting arms. The adapter 1 comprises a casing 11, a first plugging element 12, a second plugging element 13, and a locking button 14. The casing 11 is made of insulating materials such as plastic and has a body portion 111 and two connecting arms 112 connected on both sides of the body portion 111. Two side edges of the body portion 111 are recessed inwardly to provide a first sliding groove 119 respectively. The two first sliding grooves 119 extend horizontally to have a suitable length. The surfaces of the inner edges of the two connecting arms 112 are formed with a pivoting portion 113 respectively. The pivoting portion 113 is a spheric protrusion. The pivoting portion 113 is positioned on the surface of the inner edge of the connecting arm 112 away from the body portion 111.

Figure 4:
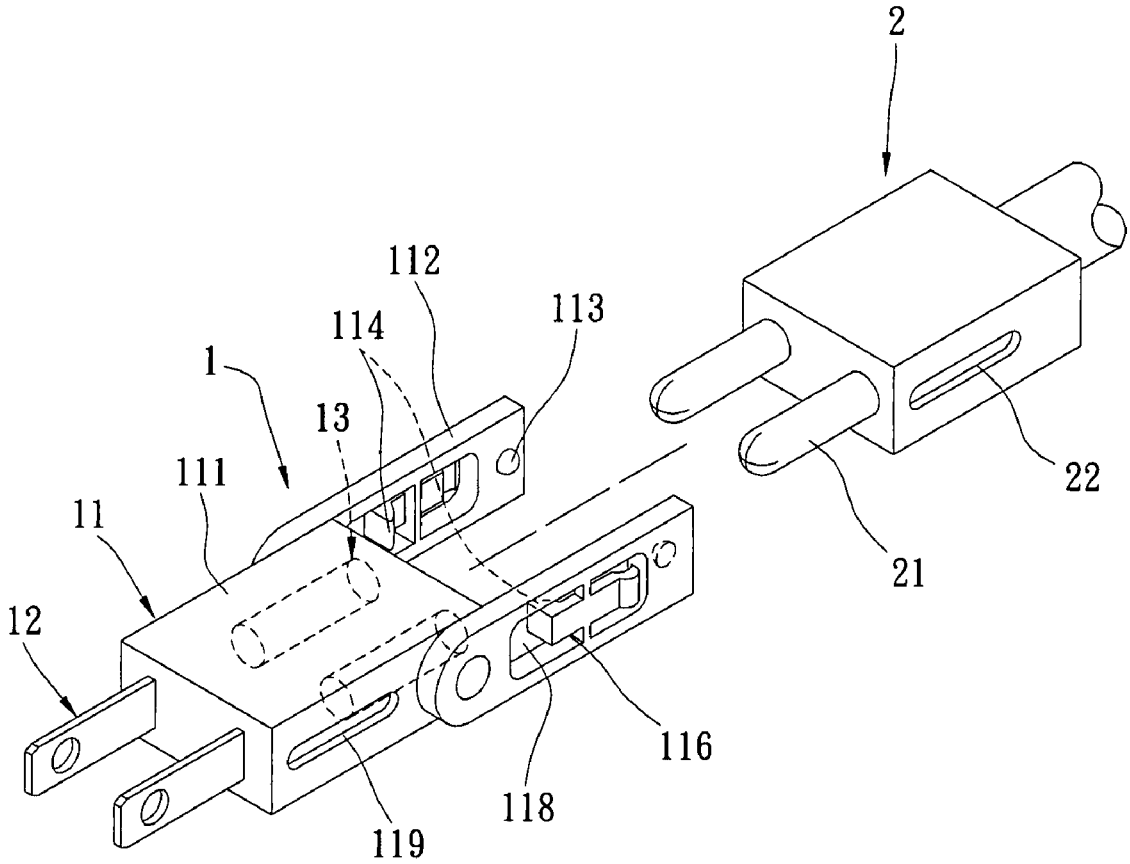
FIG. 4 is an exploded perspective view showing a second embodiment of the present invention.

The two connecting arms 112 can be rotary or immovable. In the present embodiment, the two connecting arms 112 are immovable, that is, the two connecting arms 112 are integrally formed by extending from the body portion 111. Further, as shown in FIG. 4, the two connecting arms 112 are rotary, that is, the two connecting arms 112 can be pivotally connected to two side edges of the body portion 111 respectively via rotary pivots, so that the two connecting arms 112 are capable of rotating.

The two connecting arms 112 are formed with an elastic arm 116 thereon respectively. The outer periphery of the elastic arm 116 is provided with a cutaway groove 118 having a U shape. The thickness of the elastic arm 116 is smaller than that of the connecting arm 112. One end of the elastic arm 116 is fixed to the connecting arm 112, and the other end forms a free end. The surface of the inner edge of the elastic arm 116 is provided with a protrusion 114. The protrusion 114 is provided on the surface of the inner edge of the elastic arm 116 adjacent to the body portion 111. The protrusion 114 protrudes from the inner edge of the elastic arm 116 to a proper height, thereby providing a stopping and positioning effect. Further, the elastic arm 116 and the protrusion 114 on the elastic arm 116 can swing inwardly and outwardly.

The first plugging element 12 is connected to a front end of the body portion 111 of the casing 1. The second plugging element 13 and the first plugging element 12 are installed in the body portion 111, facing in opposite directions.

Further, the first plugging element 12 and the second plugging element 13 are electrically connected with each other. Terminals (not shown) or the like can be provided between the first and second plugging elements 12, 13, thereby electrically connecting the first and second plugging elements 12, 13.

The first plugging element 12 has a plurality of conductive pins and can be bipole or tripole conductive pins of different specifications and types in the world, such as conductive pins of US, EU, UK or AU specification. The specification and type of the conductive pin are not limited.

The locking button 14 can be movably provided on the two connecting arms 112 of the casing 11. The locking button 14 has a top plate 141 and two side plates 142 connected on both sides of the top plates 141. The two side plates 142 are slidably connected to the two connecting arms 112, so that the locking button 14 is movably provided on the two connecting arms 112, thereby controlling a locking or releasing state of a locking device.

The surfaces of the inner edges of the two side plates 142 are provided with an abutting portion 143 respectively. The two abutting portions 143 protrude from the surfaces of the inner edges of the two side plates 142 to a proper height. A user can push the locking button 14 to move on the two connecting arms 112, thereby controlling the two abutting portions 143 to move along the surface of the outer edge of the connecting arm 112. In this way, the two abutting portions 143 can abut against the surfaces of the outer edges of the two elastic arms 116 or correspond to the two cutaway grooves 118, thereby controlling a locking or releasing state. Via the above arrangement, the adapter having connecting arms of the present invention can be formed.

The adapter 1 of the present invention can be assembled with a plug 2. A front end of the plug 2 is provided with a third plugging element 21. The third plugging element 21 can be bipole or tripole conductive pins of various specifications and types in the world. Thus, the specification and type of the third plugging element are not limited to the illustrated example. The second plugging element 13 is a socket for being connected with the conductive pins of the third plugging element 21.

Two side edges of the plug 2 are recessed inwardly to provide a second sliding groove 22 respectively. The second sliding grooves 22 extend horizontally to have a proper length. The plug 2 can be assembled with the adapter 1 in a manner that it moves forwardly and backwardly. The pivoting portions 113 are accommodated in the second sliding grooves 22, thereby allowing the plug 2 to be movably assembled with the adapter 1. At the same time, the third plugging element 21 of the plug 2 is inserted into the second plugging element 13, thereby achieving an electrical connection.

When the plug 2 is assembled in the casing 11 of the adapter 1, the third plugging element 21 and the second plugging element 13 can be connected with each other to achieve an electrical connection. Via a slidable engagement between the pivoting portions 113 and the second sliding grooves 22, when not in use, the plug 2 can move between the two connecting arms 112 and can rotate to different orientations. Thus, the plug 2 can be used individually without detaching the adapter 1, thereby providing convenience of usage.

Since a locking button 14 is movably provided on the two connecting arms 112 of the casing 11, the user can push the locking button 14 to move on the two connecting arms 112. In this way, the two abutting portions 143 can be made abut against the surfaces of the outer edges (FIG. 3) of the elastic arms 116 or correspond to the two grooves 118 (FIG. 2), thereby locking or releasing the adapter 1 and the plug 2 selectively.

When the plug 2 is assembled in the casing 11 of the adapter 1 in a proper position so as to achieve an electrical connection between the third plugging element 21 and the second plugging element 13, the two protrusions 114 exactly move to the front ends of the two sliding grooves 22. At this time, the locking button 14 can be pushed to make the two abutting portion 143 to abut against the surfaces of the outer edges of the two elastic arms 116, making the two elastic arms 116 unable to swing outwardly. That is, the protrusions 114 can be located in the second sliding grooves 22 only but cannot move forwardly to slide out of the second sliding grooves 22. In this way, when the adapter 1 are plug 2 move away from each other, the two protrusions 114 can be stopped and positioned by the front ends of the two second sliding grooves 22, thereby forming a locking device. As a result, when the plug 2 and the adapter 1 are assembled with each other, a good locking effect is generated therebetween. Thus, there is no risk of loosening or detaching and a secure electrical connection can be achieved.

If the locking button 14 is pushed to make the two abutting portions 143 to correspond to the two cutaway grooves 118, the abutting portions 143 leave the surfaces of the outer edges of the elastic arms 116, so that the two elastic arms 116 can swing outwardly. As a result, the protrusion 14 will not be stopped and positioned by the front end of the second sliding groove 22. The two protrusions 114 can depart from the front ends of the two sliding groove 22, so that the plug 2 and the adapter 1 can be separated from each other smoothly.

Further, as shown in FIG. 4, in the present embodiment, the elastic arms 116 and the protrusions 114 are formed into a different structure. The middle portion of the elastic arm 116 is fixed to the connecting arm 112, so that the protrusion 114 of the elastic arm 116 can swing by using the middle portion as a pivot. Further, the locking button 14 in the previous embodiment is omitted. When the plug 2 is assembled in the casing 11 of the adapter 1 in a proper position to achieve an electrical connection between the third plugging element 21 and the second plugging element 13, the two protrusions 114 exactly move to the front ends of the two second sliding grooves 22. Thus, the protrusion 114 cannot move forwardly to slide out of the second sliding groove 22. As a result, when the adapter 1 and the plug 2 move away from each other, the two protrusions 114 can be stopped and positioned by the front ends of the two second sliding grooves 22, thereby forming a locking device. When the user intends to separate the plug 2 from the adapter 1, he/she can press another end of the elastic arm 116 opposite to the protrusion 114 to raise the protrusion 114. In this way, the protrusion 114 exactly crosses the front end of the second sliding groove 22 to remove from the front end of the second sliding groove 22, so that the plug 2 and the adapter 1 can be separated form each other smoothly.

Figure 5:
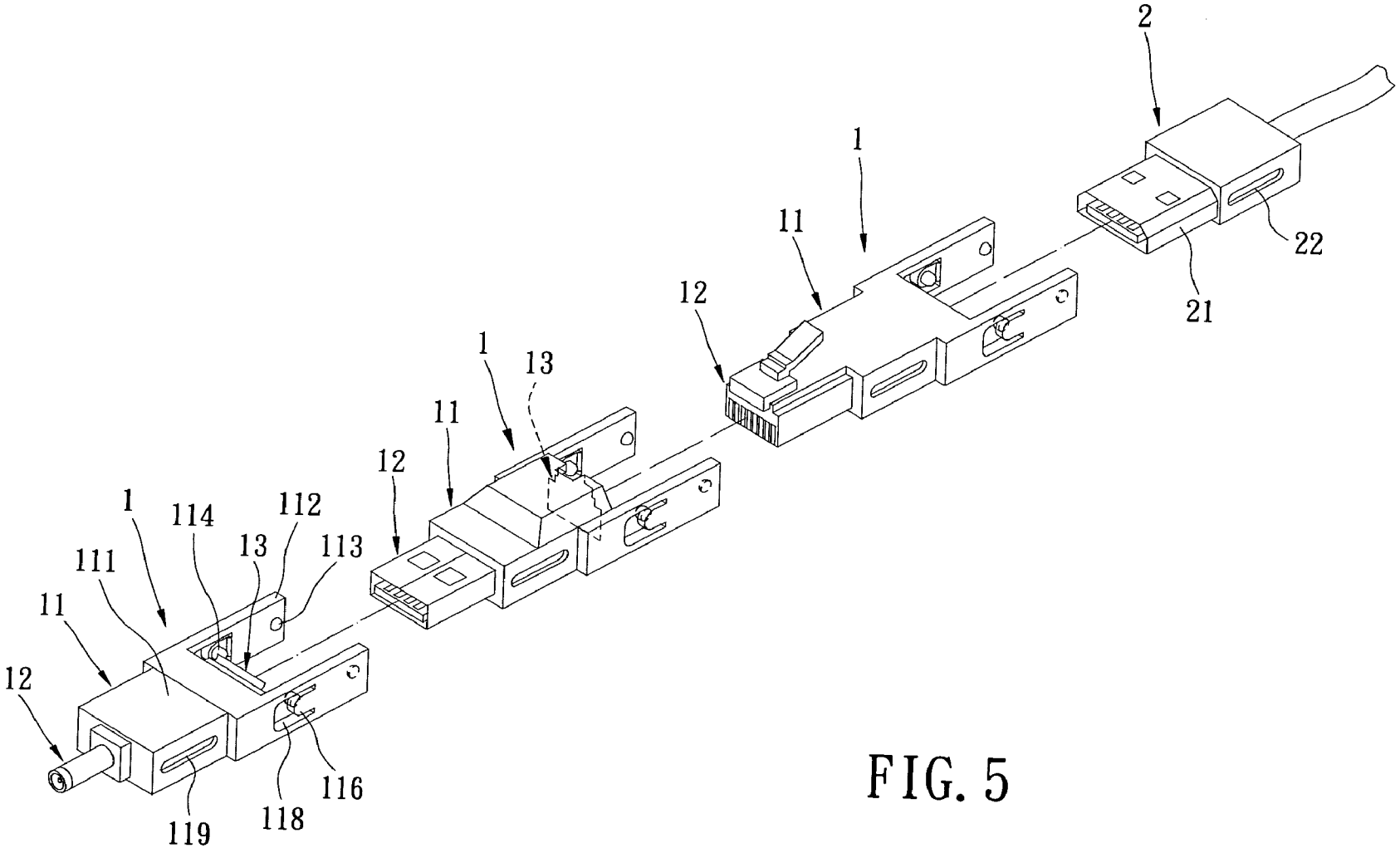
FIG. 5 is an exploded perspective view showing a third embodiment of the present invention.
Figure 6:
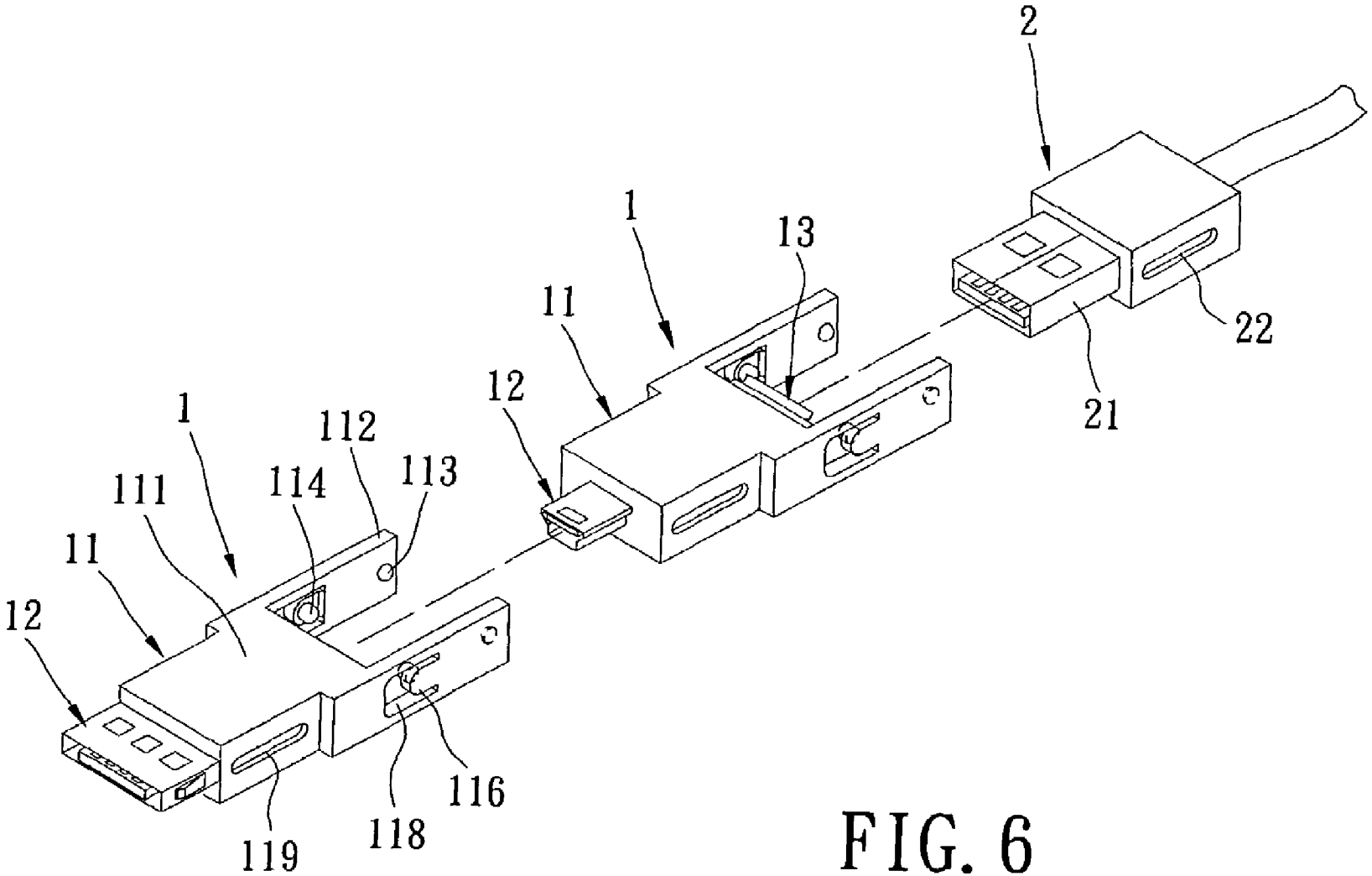
FIG. 6 is an exploded perspective view showing a fourth embodiment of the present invention.
Figure 7:
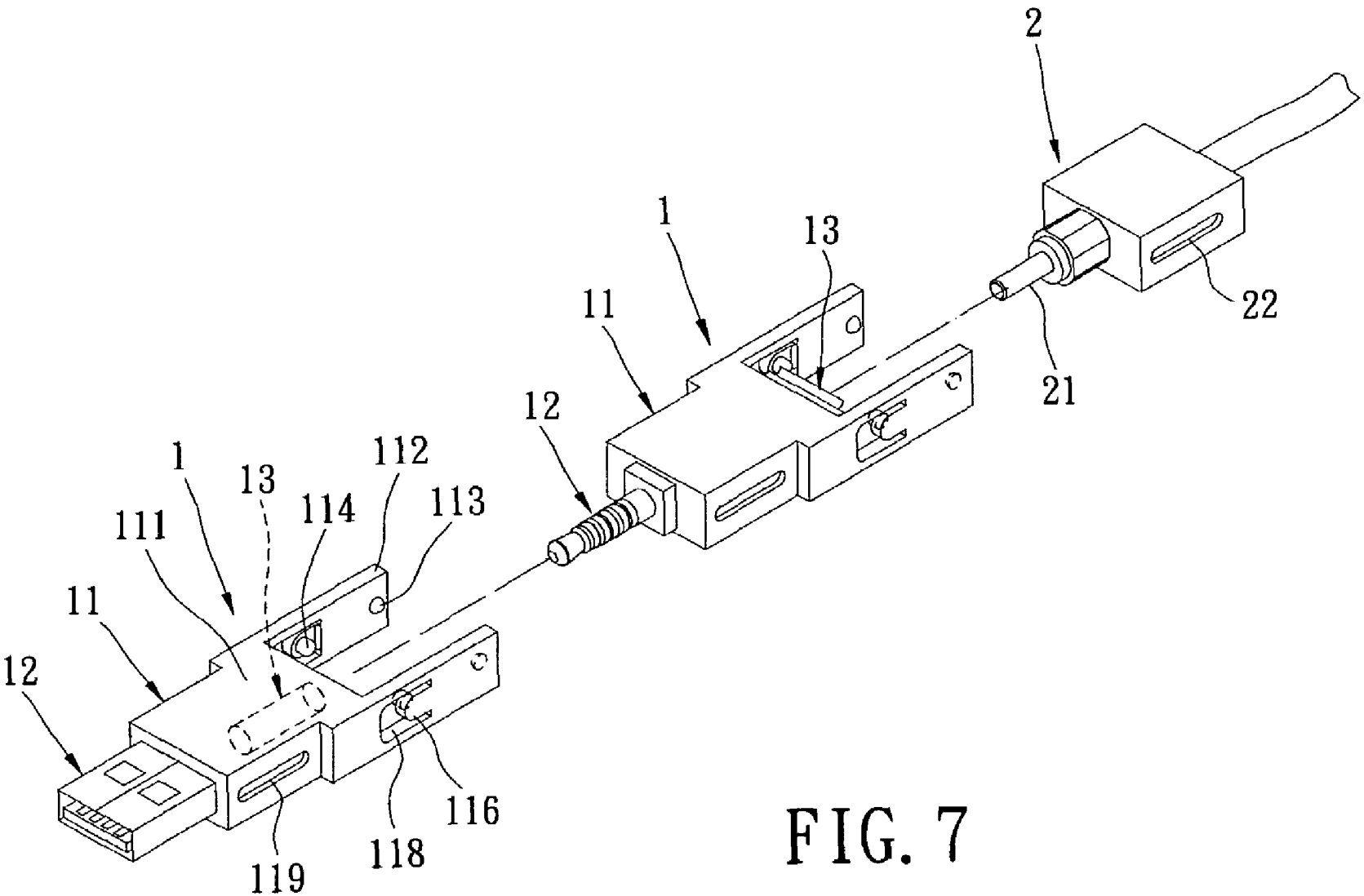
FIG. 7 is an exploded perspective view showing a fifth embodiment of the present invention.

Further, as shown in FIGS. 5 to 7, in the present invention, the first plugging element 12, the second plugging element 13 of the adapter 1, and the third plugging element 21 of the plug 2 can be formed into various plug, socket or connector for USB, AV, DC, HDMI, RJ45. Further, if desired, the plug 2 can be assembled with a plurality of adapters 1, as shown in FIG. 5.

In the present invention, the two side edges of the body portion 111 of the casing 11 of the adapter 1 are provided with first sliding grooves 119. The first sliding groove 119 can be assembled with an adapter 1 of different specification and type. That is to say, another adapter 1 can be assembled with the adapter 1 in a manner that it moves forwardly and backwardly, as shown in FIGS. 5 to 7. The two pivoting portions 113 of another adapter 1 are accommodated in the two first sliding grooves 119 of the adapter 1 correspondingly, so that another adapter 1 can be movably assembled with the adapter 1. Further, the first plugging element 12 of the adapter 1 can be inserted in the second plugging element 13 of another adapter 1, thereby achieving an electrical connection. Via a slidable engagement between the pivoting portions 113 of another adapter 1 and the first sliding grooves 119 of the adapter 1, when not in use, another adapter 1 can rotate to different orientations and the adapter 1 can be used individually without detaching another adapter 1, thereby providing convenience of usage.

Figure 8:
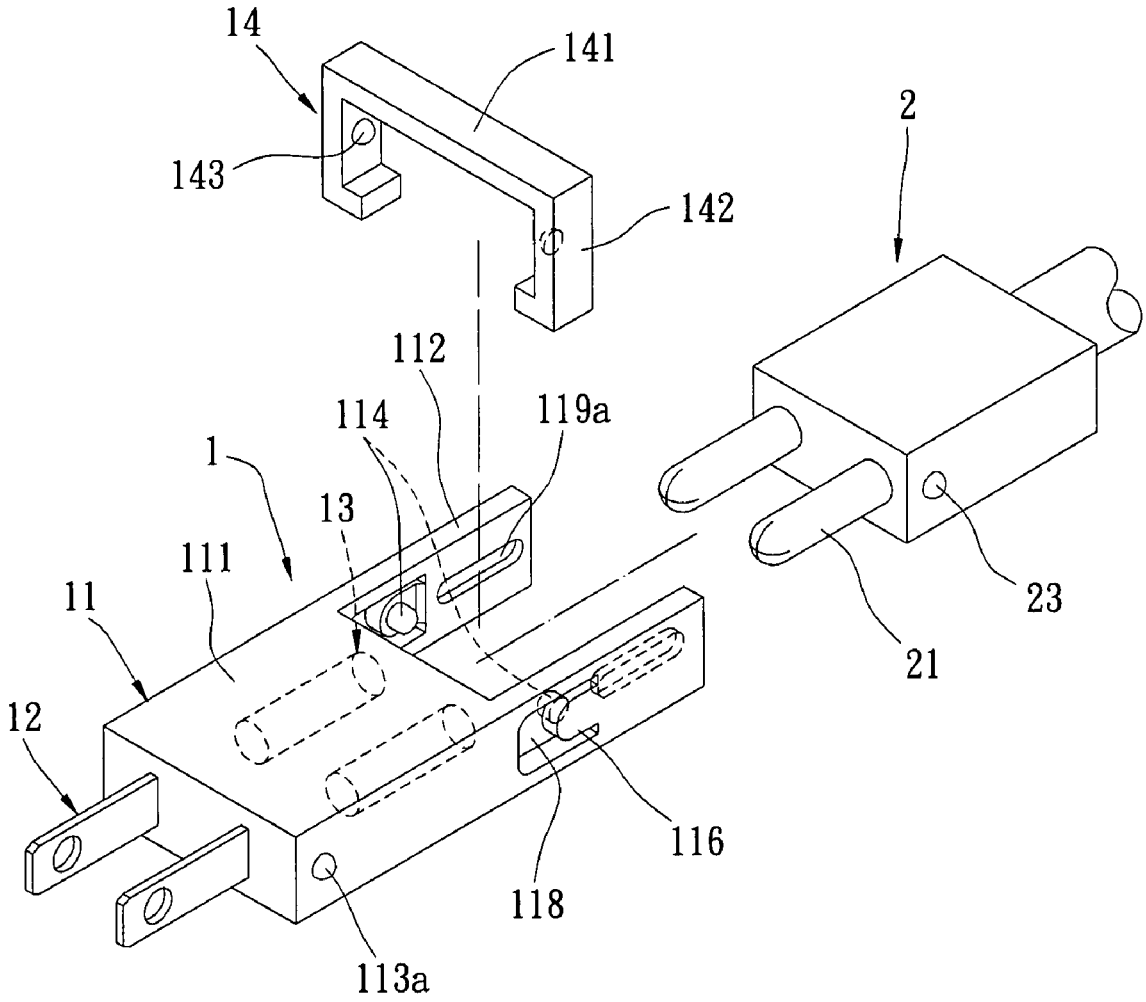
FIG. 8 is an exploded perspective view showing a sixth embodiment of the present invention.

Further, as shown in FIG. 8, in the present embodiment, the surfaces of the inner edges of the two connecting arms 112 of the casing 11 of the adapter 1 are formed with a first sliding groove 119*a* respectively, and the two side edges of the body portion 111 of the casing 11 are formed with a pivoting portion 113*a* respectively. The two side edges of the plug 2 are provided with another pivoting portion 23 respectively. The plug 2 can be assembled with the adapter 1 in a manner that it moves forwardly and backwardly. The other pivoting portion 23 is accommodated in the first sliding groove 119*a*, thereby allowing the plug 2 to be movably assembled with the adapter 1. In the present embodiment, the two side edges of the body portion 111 of the casing 11 of the adapter 1 are provided with pivoting portions 113*a*. The pivoting portion 113*a* can be assembled with another adapter 1 of other specification and type. That is to say, another adapter 1 can be assembled with the adapter 1 in a manner that it moves forwardly and backwardly. The two first sliding grooves 119*a* of another adapter 1 can accommodate the two pivoting portions 113*a* of the adapter 1, so that another adapter 1 can movably assembled with the adapter 1.

Figure 9:
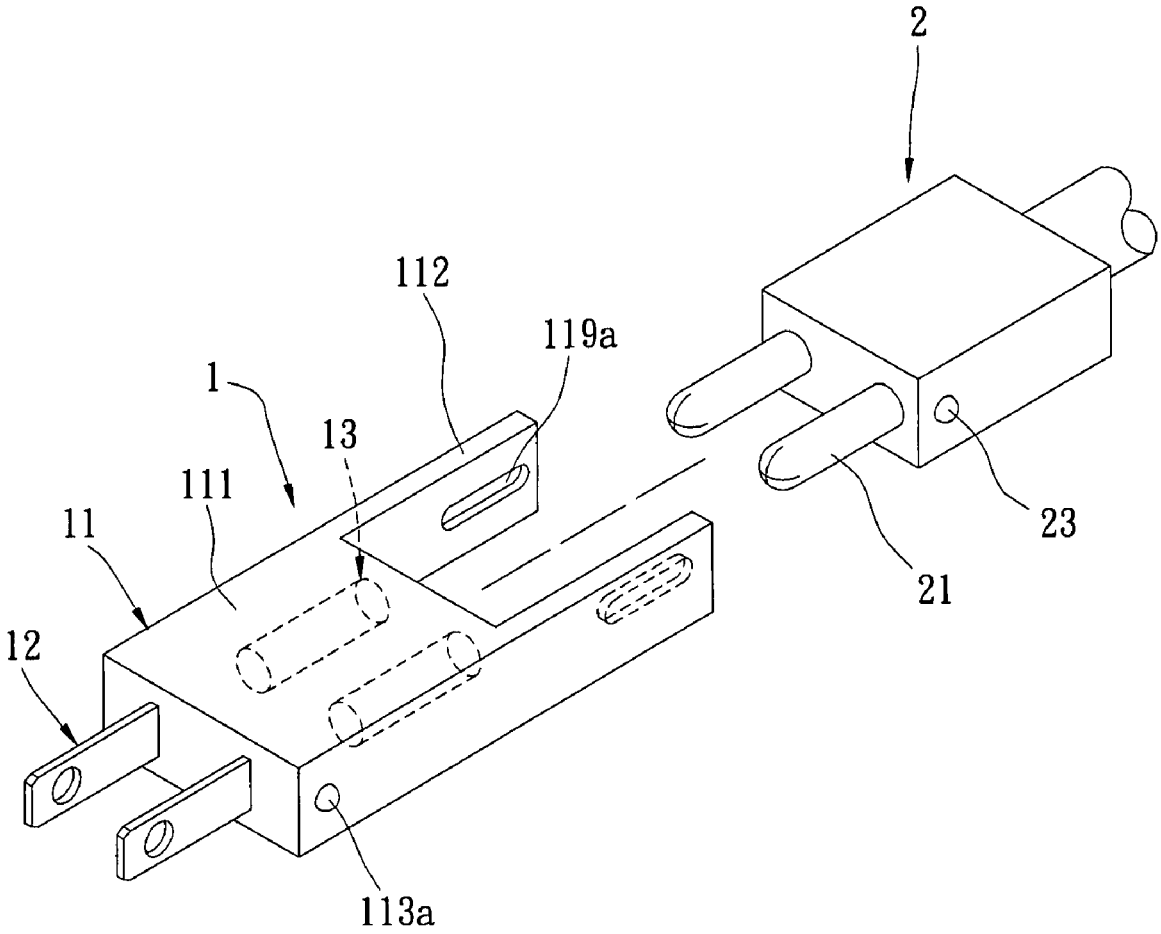
FIG. 9 is an exploded perspective view showing a seventh embodiment of the present invention.

Further, as shown in FIG. 9, in the present embodiment, the elastic arm 116, the cutaway groove 118, the protrusion 114 and the locking button 14 in the previous embodiment are omitted.

Figure 10:
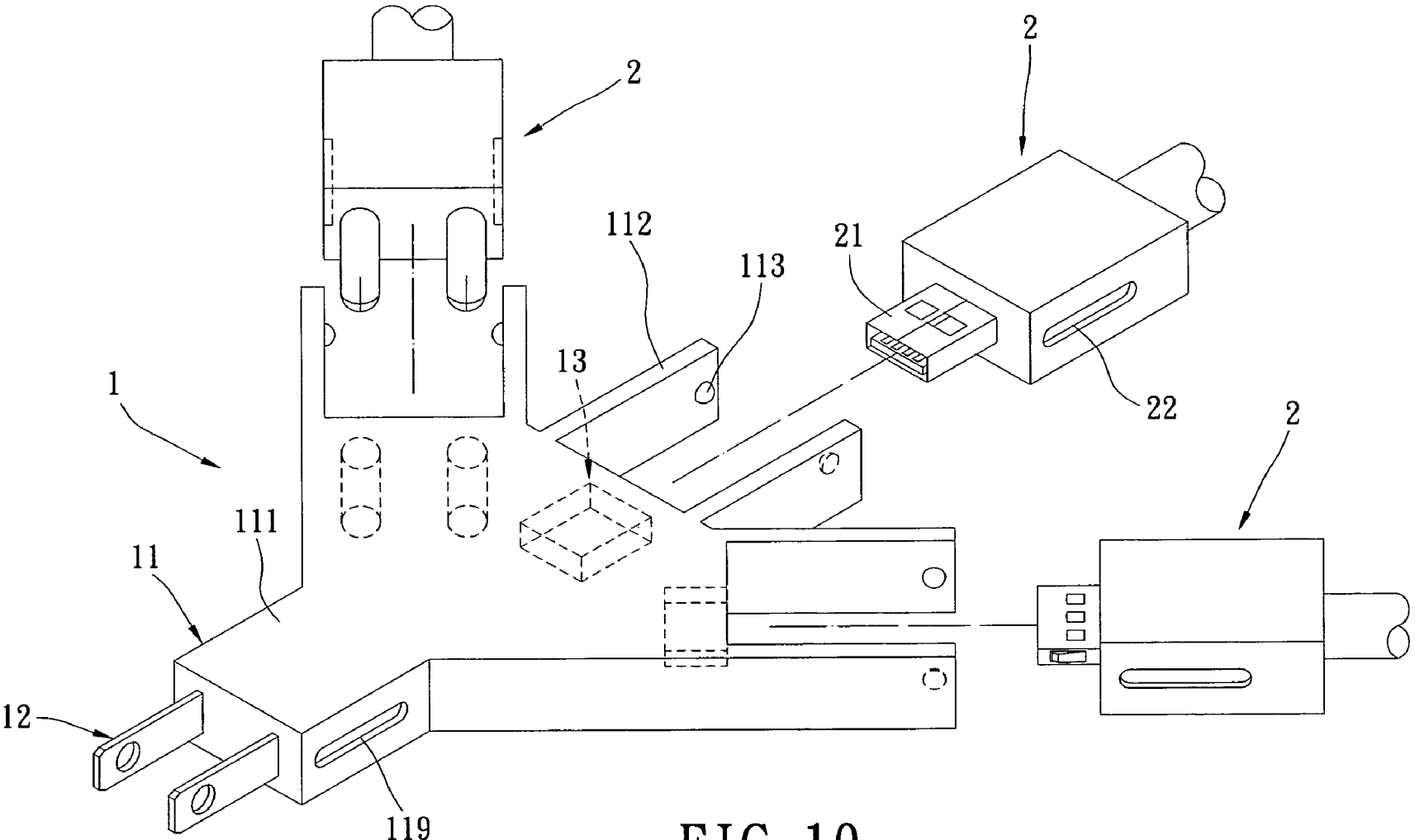
FIG. 10 is an exploded perspective view showing an eighth embodiment of the present invention.

Further, as shown in FIG. 10, in the present embodiment, the casing 11 of the adapter 1 has a plurality of connecting arms 11 and a plurality of second plugging elements 13 of different specifications and types, so that the adapter 1 can be movably assembled with a plurality of plugs 2 of different specifications and types.

The adapter 1 of the present invention can not only be assembled with a corresponding power supply plug 1, but also the adapter 1 can be assembled with other adapters 1 of different specifications and types, thereby diversifying the purposes thereof to provide more functionality.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. An adapter having connecting arms, comprising:

a casing having connecting arms, the connecting arms being provided with pivoting portions, side edges of the casing being formed with first sliding grooves; and a first plugging element and a second plugging element, the first and the second plugging element being electrically connected inside the casing, and facing in opposite directions;

wherein the adapter is movably assembled with a plug, and the side edges of the plug are formed with second sliding grooves to correspond to the pivoting portions.

2. The adapter according to claim 1, wherein the casing has a body portion, and the connecting arms are connected to both sides of the body portion.

3. The adapter according to claim 1, wherein the connecting arm is rotary or immovable.

4. The adapter according to claim 1, wherein the connecting arm contains an elastic arm, the surface of the inner edge of the elastic arm has a protrusion, a locking button is movably provided on the connecting arm, and the surface of the inner edge of the locking button is provided with abutting portions.

5. The adapter according to claim 4, wherein the abutting portion abuts against the surface of the outer edge of the elastic arm.

6. The adapter according to claim 4, wherein the connecting arm is provided thereon with a cutaway groove, and the abutting portion corresponds to the cutaway groove.

7. The adapter according to claim 4, wherein the locking button has a top plate and two side plates connected to both sides of the top plate respectively, the two side plates are slidably connected to the connecting arms, and the abutting portions are provided on the surface of the inner edge of the side plate.

8. The adapter according to claim 1, wherein there is a plurality of connecting arms and second plugging elements.

9. An adapter having connecting arms, comprising:

a casing having connecting arms extending outward from said casing, the connecting arms being provided with cutaway grooves, side edges of the casing being formed with pivoting portions; and a first plugging element and a second plugging element, the first and the second plugging elements being combined opposite in the casing to be electrically connected with each other.

10. An adapter having connecting arms, comprising:

a casing having connecting arms extending outward from said casing, the connecting arms being provided with pivoting portions, side edges of the casing being formed with first sliding grooves; and a first plugging element and a second plugging element, the first and the second plugging element being electrically connected inside the casing, and facing in opposite directions;

wherein the adapter is movably assembled with a plug, and the side edges of the plug are formed with second sliding grooves to correspond to the pivoting portions.

11. The adapter according to claim 10, wherein the casing has a body portion, and the connecting arms are connected to both sides of the body portion.

12. The adapter according to claim 10, wherein the connecting arm is rotary or immovable.

13. The adapter according to claim 10, wherein the connecting arm contains an elastic arm, the surface of the inner edge of the elastic arm has a protrusion, a locking button is movably provided on the connecting arm, and the surface of the inner edge of the locking button is provided with abutting portions.

14. The adapter according to claim 13, wherein the abutting portion abuts against the surface of the outer edge of the elastic arm.

15. The adapter according to claim 13, wherein the connecting arm is provided thereon with a cutaway groove, and the abutting portion corresponds to the cutaway groove.

16. The adapter according to claim 13, wherein the locking button has a top plate and two side plates connected to both sides of the top plate respectively, the two side plates are slidably connected to the connecting arms, and the abutting portions are provided on the surface of the inner edge of the side plate.

17. The adapter according to claim 10, wherein there is a plurality of connecting arms and second plugging elements.

* * * * *